United States Patent [19]

Yamagishi et al.

[11] Patent Number: 5,024,444

[45] Date of Patent: Jun. 18, 1991

[54] GOLF BALL

[75] Inventors: Hisashi Yamagishi; Shinichi Kakiuchi, both of Yokohama; Seisuke Tomita, Tokorozawa, all of Japan

[73] Assignee: Bridgestone Corporation, Tokyo, Japan

[21] Appl. No.: 435,207

[22] Filed: Nov. 9, 1989

[30] Foreign Application Priority Data

Dec. 2, 1988 [JP] Japan ..... 63-305561

[51] Int. Cl.[5] ..... A63B 37/12

[52] U.S. Cl. ..... 273/232; 40/327

[58] Field of Search ..... 273/232, 213; 40/327

[56] References Cited

U.S. PATENT DOCUMENTS

| | | | |
|---|---|---|---|
| 4,840,381 | 6/1989 | Ihara et al. | 273/232 |
| 4,858,923 | 8/1989 | Gobush et al. | 273/232 |

FOREIGN PATENT DOCUMENTS

| | | | |
|---|---|---|---|
| 0218311 | 4/1987 | European Pat. Off. | 273/232 |
| 1415413 | 9/1978 | United Kingdom . | |
| 2150840 | 7/1985 | United Kingdom . | |
| 2153690 | 8/1985 | United Kingdom . | |

*Primary Examiner*—George J. Marlo

[57] ABSTRACT

A golf ball having at least three different sizes of dimples and whose total dimple area quotient is optimized for increasing the golf ball's flying distance. The dimple area quotient represents the sum of the surface area indexes of all dimples divided by the surface area of the ball. The golf ball contains a plurality of dimples disposed about the spherical surface of the golf ball, and said plurality of dimples includes at least three types of dimples, said plurality of dimples having a total dimple surface area quotient Dst of at least 4, wherein the total dimple surface area quotient Dst is defined as:

$$Dst = \frac{n \sum_{k=1}^{n} [(Dmk^2 + Dpk^2) \times Vok \times Nk]}{4R^2}$$

wherein n is a positive integer of at least 3, k is one of plurality of discrete dimple groups covering the spherical surface of said golf ball, Nk is the number of dimples belonging to a group k, wherein k is 1, 2, 3, . . . , n, Dmk is the diameter of dimples belonging to a selected group k, Dpk is the depth of dimples belonging to a selected group k, R is the radius of the ball, and Vo is a value obtained by dividing the volume of the dimple space defined between the surface of each dimple and a plane defined by the periphery of each dimple by the volume of a cylinder having said plane defined by the periphery of each dimple as its base and the maximum depth of each dimple as its height.

7 Claims, 3 Drawing Sheets

GOLF BALL

This invention relates to golf balls having improved flying performance.

BACKGROUND OF THE INVENTION

The dimples on a golf ball play the role of assisting the transition of a boundary layer created in proximity to the ball surface due to motion and rotation of the ball from laminar flow to turbulent flow to move the point of separation rearward, thereby reducing pressure drag and creating a lifting force due to the difference of separation point between upper and lower positions of the ball. The separation point varies as various dimple parameters such as diameter and depth are changed. Thus the flying orbit of a golf ball is determined by a particular setting of dimple parameters.

The dimple parameters are one of the important factors for improving the flying performance of golf balls as described above. A variety of technical proposals have been made in the past for configuring the dimples on golf balls, particularly regarding the dimple distribution pattern and dimple configurations including dimensions such as diameter and depth. For example, U.S. Pat. No. 4,681,323 discloses the cross-sectional shape of dimples, U.S. Pat. No. 4,840,381 discloses the relationship between the cross-sectional shape and volume of dimples, and Japanese Patent Application Kokai No. 51871/1988 discloses the distribution of dimples.

There still exists a demand for further improving the flying performance of golf balls.

SUMMARY OF THE INVENTION

An object of the present invention is to provide a novel and improved golf ball wherein dimple parameters are optimized to improve the ball's flying performance.

According to the present invention, there is provided a golf ball having n groups of dimples wherein the total dimple surface area quotient Dst is at least 4 and n is a positive integer of at least 2. The total dimple surface area quotient Dst is given by the following expression:

$$Dst = \frac{n \sum_{k=1}^{n} [(Dmk^2 + Dpk^2) \times Vok \times Nk]}{4R^2} \quad (1)$$

In the expression, Nk is the number of dimples belonging to each group k wherein k is 1, 2, 3, . . . , and n, Dmk is the diameter of dimples belonging to group k, Dpk is the depth of the dimples belonging to group k, R is the radius of the ball, and Vo is a value obtained by dividing the volume of the dimple space defined between the surface of a dimple k and a plane defined by the periphery of the dimple k by the volume of a cylinder having said plane defined by the periphery of the dimple k as its base and the maximum depth of the dimple k as its height.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

The present invention is based on the concept that the dimples on a golf ball can be regarded as the surface roughness of a sphere. The total dimple surface area quotient Dst is derived by expressing the surface roughness as the sum of indexes of surface areas of all dimples and dividing the sum by the surface area of the ball. Then the flying performance is improved by optimizing the total dimple surface area quotient Dst.

Figure 1:
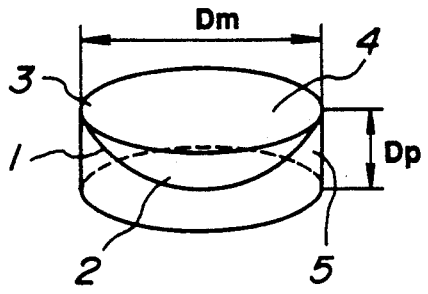
FIGS. 1, 2, and 3 illustrate how to calculate the total dimple surface are quotient Dst.
Figure 2:
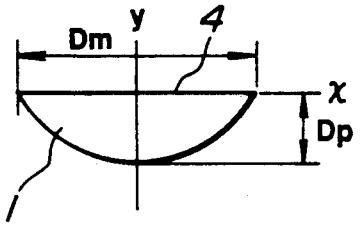

The total dimple surface area quotient Dst is first described with reference to FIGS. 1 to 3. A single dimple 1 is illustrated as a segment of the spherical surface 6 of a sphere 7, the segment terminating at a circular periphery 3. The circular periphery 3 defines a plane 4. A dimple space 2 is defined between the spherical dimple surface segment and the plane 4. The dimple 1 has a diameter Dm and a depth Dp, the depth being in a radial direction y of a golf ball (not shown).

The space 2 of the dimple 1 has a volume V1 which is given by the expression:

$$V1 = \int_0^{\frac{Dm}{2}} 2\pi xydx \quad (2)$$

A cylinder 5 whose base is defined by the plane 4 and whose height is defined by the maximum dimple depth Dp has a volume V2 which is given by the expression:

$$V2 = \frac{\pi Dm^2 Dp}{4} \quad (3)$$

The ratio Vo of dimple volume V1 to cylinder volume V2, that is, $$Vo = V1/V2 \quad (4)$$

is calculated from expressions (2) and (3). See U.S. Pat. No. 4,681,323 which is incorporated herein by reference.

Figure 3:
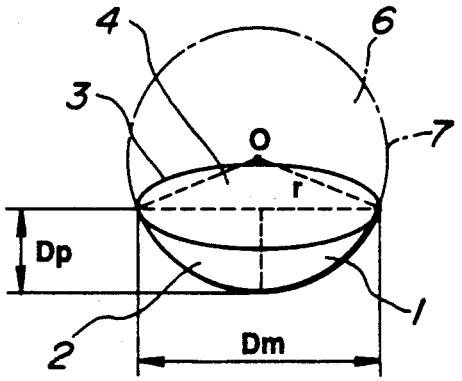
Figure 4:
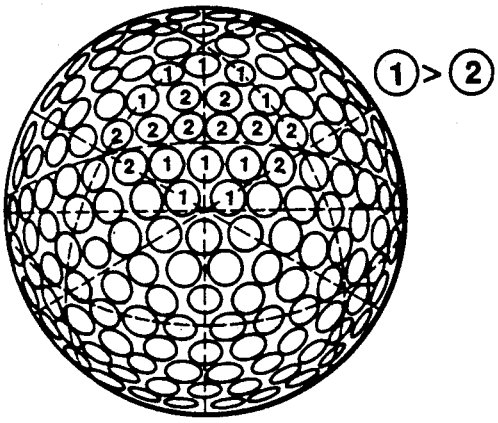
FIGS. 4 through 9 are plan views showing different dimple distribution patterns on golf balls.
Figure 5:
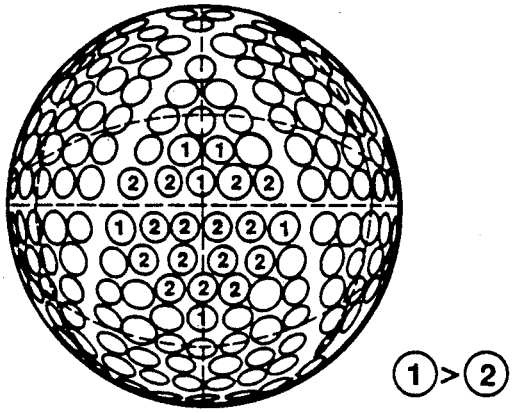
Figure 6:
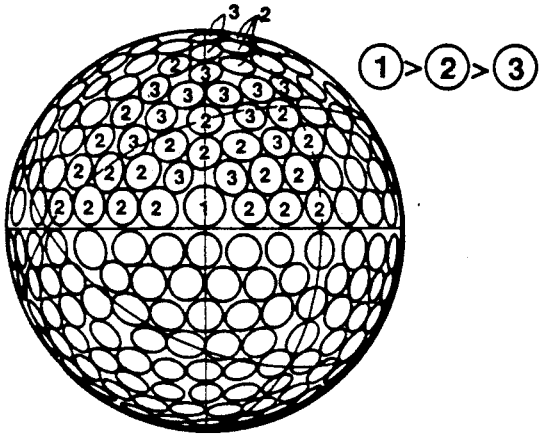
Figure 7:
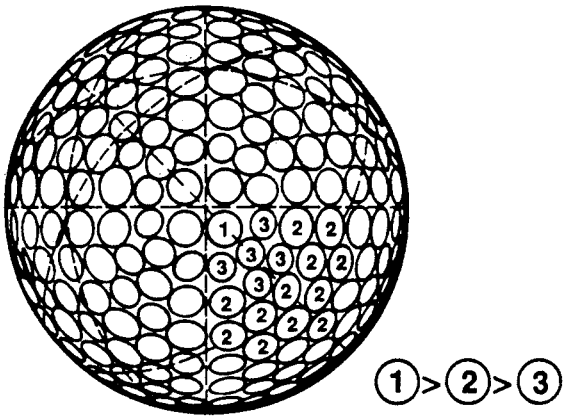
Figure 8:
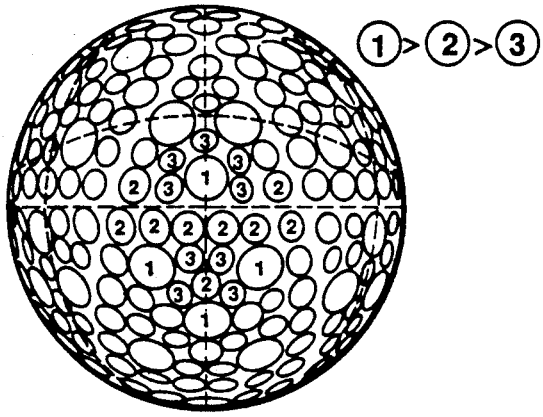

As shown in FIG. 3, the sphere 7 has a radius r and presents the spherical surface 6 including the segment forming the dimple 1 having the diameter Dm and the depth Dp. The spherical surface 6 has a surface area a which is given by the expression:

$$a = \pi(Dp^2 + Dm^2) \quad (5)$$

The surface area index S of the dimple 1 is determined by multiplying the surface area a by the ratio Vo.

$$S = a \times Vo = \pi(Dp^2 + Dm^2) \times Vo \quad (6)$$

The golf ball has n groups of Nk dimples (Nk is the number of dimples belonging to group k). By extending the equation (6) for one dimple to all the dimples, the total dimple surface area index St is given by the following equation:

$$St = n\pi \sum_{k=1}^{n} [(Dmk^2 + Dpk^2) \times Vok \times Nk] \quad (7)$$

Then, the total dimple surface area quotient Dst is obtained by dividing the total dimple surface area index St by the total surface area of the ball having a radius R.

$$Dst = \frac{n \sum_{k=1}^{n} [(Dmk^2 + Dpk^2) \times Vok \times Nk]}{4R^2} \quad (1)$$

The golf ball of the invention is characterized in that the total dimple surface area quotient Dst calculated from equation (1) is at least 4, preferably from 4 to 8.

in one preferred embodiment of the golf ball having at least two different groups of dimples, the difference between the diameter divided by the depth of each dimple, that is, the ratio of diameter to depth, for one group of dimples and that for another group of dimples is up to 0.3, preferably up to 0.1. That is, $|Dm1/Dp1 - Dm2/Dp2| \leqq 0.3$ wherein dimples of one gruop has a diameter Dm1 and a depth Dp1 and dimples of another group has a diameter Dm2 and a depth Dp2. Then the dimples of one group are in substantial or complete conformity to those of the other group. Then all the dimples show substantially identical aerodynamic properties to ensure that the individual dimples may exert their own dimple effect, leading to improved flying performance. This feature, is the subject matter of the concurrently filed U.S. application Ser. No. 07/435,208, assigned to the same assignee as the present invention. Of course, the present invention is not limited to this feature.

The dimples arranged in the spherical surface of a ball include two or more groups of dimples each preferably having a Vo value in the range of from 0.35 to 0.55, a diameter in the range of from 2.7 to 4.4 mm, a depth in the range of from 0.15 to 0.24 mm, and a ratio of diameter to depth in the range between 10 and 35, more preferably between 13 and 25, though the invention is not limited thereto. Often two, three or four groups of dimples are formed on a ball although more groups of dimples may be included.

When a ball includes two groups of dimples, that is, larger and smaller dimples, the number of larger dimples preferably ranges from 40 to 60%, more preferably from 40 to 50% of the total number of dimples. When a ball includes m groups of dimples wherein m is an odd number of at least 3, the number of the largest dimples to the (m+1)/2-th largest dimples preferably ranges from 50 to 90%, more preferably from 65 to 85% of the total number of dimples. When a ball includes n groups of dimples wherein n is an even number of at least 4, the number of the largest dimples to the n/2-th largest dimples preferably ranges from 25 to 60%, more preferably from 25 to 50% of the total number of dimples.

The golf balls of the invention may be either solid balls including one and two-piece balls or thread-wound balls. The distribution and total number of dimples are not particularly limited although 300 to 550 dimples, preferably 350 to 540 dimples are generally formed on a ball.

Preferred dimple arrangements are regular icosahedral, regular dodecahedral, and regular octahedral arrangements. The dimples may preferably be distributed uniformly on the ball surface according to any of the above mentioned arrangements.

The dimple design defined by the present invention may be applied to any type of golf ball including small balls having a diameter of at least 41.15 mm and a weight of up to 45.92 g, and large balls having a diameter of at least 42.67 mm and a weight of up to 45.29 g.

EXAMPLE

Examples of the invention are given below by way of illustration and not by way of limitation.

Example

Figure 9:
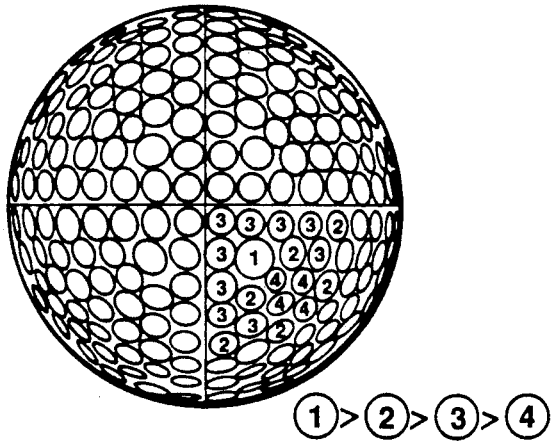

There were prepared two-piece balls of the large size having dimple parameters shown in Table 1. Table 1 shows the diameter Dm and depth Dp of dimples, Dm/Dp, Vo, the number of dimples of each group, the difference between maximum Dm/Dp and minimum Dm/Dp, and quotient Dst. The dimple distribution patterns used are shown in FIGS. 4 through 9. In the figures, numeral 1 designates the largest dimples, and 2 designates second largest dimples. In FIGS. 4 through 8, 3 designates the smallest dimples. In FIG. 9, 3 designates third largest dimples and 4 designates the smallest dimples.

| Two-piece ball | |
|---|---|
| Composition | Parts by weight |
| Core | |
| Cis-1,4-polybutadiene rubber | 100 |
| Zinc dimethacrylate | 30 |
| Filler | appropriate |
| Peroxide | appropriate |
| Cover | |
| Ionomer resin (Surlyn ® 1707, E. I. duPont, Shore D hardness 68) | 100 |
| Titanium dioxide | 1 |
| Thickness: 2.3 mm | |

A solid core was formed by vulcanizing the core composition in a mold at 150° C. for 25 minutes. The solid core was coated with the cover composition, which was compression molded in a mold at 130° C. for 3 minutes. There was prepared a large-size, two-piece ball having a diameter of 42.7 mm, a weight of 45.2 grams, and a hardness of 100 as measured by the USGA standard.

Figure 10:
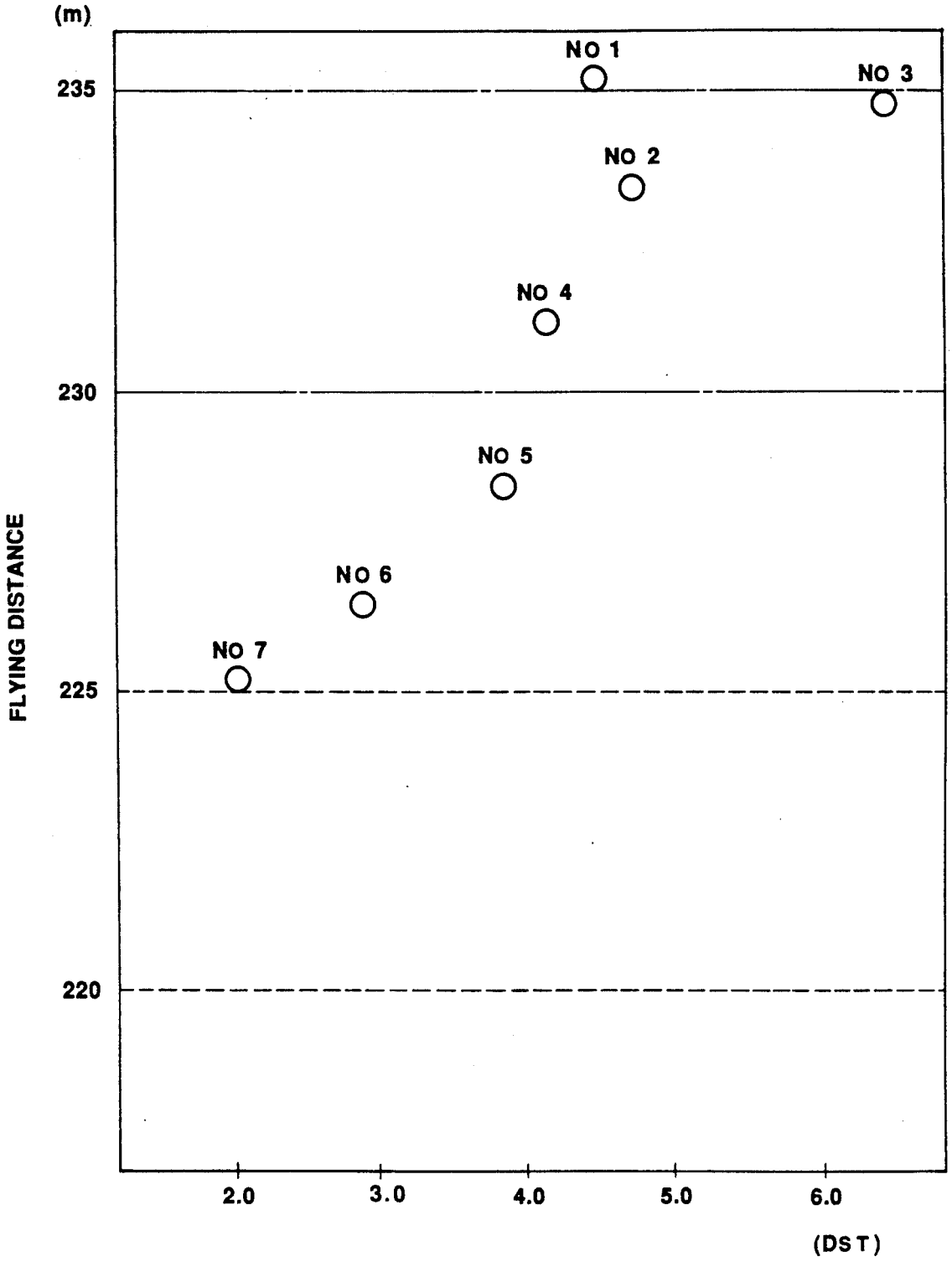
FIG. 10 is a diagram showing the flying distance of golf balls having different total dimple surface area quotients Dst.

To evaluate the flying distance of these balls, a hitting test was carried out using a swing robot manufactured by True Temper Co. The ball was hit at a head speed of 45 m/sec. and the flying distance covered by the ball was measured as a total distance of a carry plus a run. The flying distance is an average of 20 hits. The results are shown in FIG. 10.

TABLE 1

| No. | Dimple diameter (Dm) | Dimple depth (Dp) | Dm/Dp | $V_0$ | Number of dimples | max. Dm/Dp − min. Dm/Dp | $D_{ST}$ | Dimple distribution pattern | |
|---|---|---|---|---|---|---|---|---|---|
| 1 | 4.10 mm | 0.210 mm | 19.52 | 0.490 | 24 | 0.03 | 4.45 | FIG. 7 | Invention |
| | 3.90 | 0.200 | 19.50 | 0.490 | 248 | | | | |

TABLE 1-continued

| No. | Dimple diameter (Dm) | Dimple depth (Dp) | Dm/Dp | $V_0$ | Number of dimples | max. Dm/Dp − min. Dm/Dp | $D_{ST}$ | Dimple distribution pattern | |
|---|---|---|---|---|---|---|---|---|---|
| | 3.30 | 0.169 | 19.53 | 0.490 | 120 | | | | |
| 2 | 4.35 | 0.225 | 19.33 | 0.510 | 10 | 1.78 | 4.74 | FIG. 6 | " |
| | 4.05 | 0.205 | 19.76 | 0.510 | 200 | | | | |
| | 3.80 | 0.180 | 21.11 | 0.468 | 162 | | | | |
| 3 | 4.00 | 0.195 | 20..51 | 0.500 | 24 | 0.05 | 6.40 | FIG. 9 | " |
| | 3.80 | 0.185 | 20.54 | 0.500 | 96 | | | | |
| | 3.70 | 0.180 | 20.56 | 0.500 | 216 | | | | |
| | 3.35 | 0.163 | 20.55 | 0.500 | 96 | | | | |
| 4 | 5.10 | 0.235 | 21.70 | 0.520 | 54 | 6.70 | 4.17 | FIG. 8 | " |
| | 3.60 | 0.220 | 16.36 | 0.520 | 174 | | | | |
| | 3.00 | 0.200 | 15.00 | 0.520 | 132 | | | | |
| 5 | 4.10 | 0.175 | 23.43 | 0.420 | 24 | 2.81 | 3.81 | FIG. 7 | Comparison |
| | 3.90 | 01.70 | 22.94 | 0.420 | 248 | | | | |
| | 3.30 | 0.160 | 20.63 | 0.420 | 120 | | | | |
| 6 | 3.80 | 0.225 | 16.89 | 0.530 | 168 | 0.07 | 2.87 | FIG. 4 | " |
| | 3.60 | 0.214 | 16.82 | 0.530 | 192 | | | | |
| 7 | 3.60 | 0.180 | 20.00 | 0.450 | 150 | 1.11 | 2.01 | FIG. 5 | " |
| | 3.40 | 0.180 | 18.89 | 0.450 | 210 | | | | |

There has been described a golf ball in which a total dimple surface area quotient which is the sum of surface areas indexes of all dimples divided by the surface area of the ball is adopted as a dimple parameter and optimized so as to increase the flying distance.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A golf ball, comprising:

a plurality of dimples disposed about the spherical surface of the golf ball, wherein said plurality of dimples includes at least three types of dimples, said plurality of dimples having a total dimple surface area quotient Dst of at least 4, wherein the total dimple surface area quotient Dst is defined as:

$$Dst = \frac{n \sum_{k=1}^{n} [(Dmk^2 + Dpk^2) \times Vok \times Nk]}{4R^2}$$

wherein n is a positive integer of at least 3,

Group k is one of a plurality of discrete dimple groups covering the spherical surface of said golf ball, Nk is the number of dimples belonging to a group k, wherein k is 1, 2, 3, . . . , through n, Dmk is the diameter of dimples belonging to a selected group k, Dpk is the depth of dimples belonging to a selected group k, R is the radius of the ball, and Vo is a value obtained by dividing the volume of the dimple space defined between the surface of each dimple and a plane defined by the periphery of each dimple by the volume of a cylinder having said plane defined by the periphery of each dimple as its base and the maximum depth of each dimple as its height.

2. The golf ball of claim 1 wherein said total dimple surface area quotient Dst is in the range from 4 to 8.

3. The golf ball of claim 1 wherein the dimples have a diameter in the range of from 2.7 to 4.4 mm a depth in the range of from 0.15 to 0.24 mm, with the ratio of diameter of depth being in the range between 10 and 35.

4. The golf ball of claim 1 wherein three or four types of dimples are present.

5. The golf ball of claim 1 wherein three (3) types of dimples are present and the number of the largest dimples and the second largest dimples range from 50 to 90% of the total number of dimples over the surface of said golf ball.

6. The golf ball of claim 1 wherein four types of dimples are present and the number of the larges dimples ranges from 25 to 60% of the total number of dimples.

7. The golf ball of claim 1 wherein Vo has a value in the range of 0.35 to 0.55.

* * * * *